United States Patent [19]

Williams

[11] Patent Number: 4,516,547

[45] Date of Patent: May 14, 1985

[54] FUEL SUPPLY SYSTEM

[75] Inventor: Derek Williams, Hertford, England

[73] Assignee: Lucas Industries public limited company, Birmingham, England

[21] Appl. No.: 515,179

[22] Filed: Jul. 19, 1983

[30] Foreign Application Priority Data

Aug. 3, 1982 [GB] United Kingdom ..... 8222350

[51] Int. Cl.[3] ..... F02D 19/00

[52] U.S. Cl. ..... 123/198 A; 123/1 A; 123/25 E; 123/531

[58] Field of Search ..... 123/25 B, 25 C, 25 D, 123/25 P, 25 E, 1 A, 198 A, 531

[56] References Cited

U.S. PATENT DOCUMENTS

| | | | |
|---|---|---|---|
| 3,450,116 | 6/1969 | Knight et al. | 123/531 |
| 3,987,774 | 10/1976 | Waag | 123/25 R |
| 4,030,453 | 6/1977 | Sugimoto | 123/25 B |
| 4,031,864 | 6/1977 | Crothers | 123/25 A |
| 4,173,450 | 11/1979 | Schrank | 123/25 R |
| 4,368,711 | 1/1983 | Allen | 123/25 B |
| 4,388,893 | 6/1983 | Apfel | 123/25 C |

FOREIGN PATENT DOCUMENTS 116388 6/1918 United Kingdom .

*Primary Examiner*—Ira S. Lazarus

[57] ABSTRACT

A fuel supply system for an internal combustion engine includes a fuel pump which draws fuel from a supply tank. A subsidiary fuel tank receives fuel from the supply by way of a conduit which incorporates a one way valve. The inlet of the pump is connected to a pipe which extends to adjacent the lower wall of the subsidiary tank. The subsidiary tank can be pressurized with air to force fuel towards the pump and a safety valve is fitted to the subsidiary tank to limit the pressure build up therein.

5 Claims, 3 Drawing Figures

FUEL SUPPLY SYSTEM

This invention relates to a fuel supply system for an internal combustion engine, the fuel system being of the kind comprising a fuel delivery unit through which fuel can be supplied to an associated engine, a fuel supply pump for supplying fuel to the delivery unit and a supply tank from which fuel is drawn in use by the supply pump.

Systems of the kind set out above are often supplied with some form of priming device which can be operated when it is required to prime the fuel delivery unit with fuel to enable it to deliver fuel as quickly as possible when for example, air has been allowed to enter the system. The priming device may be in the form of a lever associated with the fuel supply pump or it may be a or part of a special pump provided for the purpose. In each case it is expensive to provide and in those cases where it is a manual device it is not always convenient to operate.

The object of the present invention is to provide a fuel supply system in a simple and convenient form.

According to the invention a fuel supply system of the kind specified comprises a subsidiary fuel tank, a conduit through which said subsidiary fuel tank can be supplied with fuel from the supply tank, a one-way valve in said conduit, said one-way valve acting to prevent the flow of fuel from the subsidiary fuel tank to the supply tank, and a further conduit through which said subsidiary fuel tank can be pressurized with air to force fuel from the subsidiary fuel tank towards said fuel delivery unit.

Three examples of fuel supply system in accordance with the invention will now be described with reference to the accompanying drawings, in which the three views are diagrammatic views of three systems.

Figure 1:
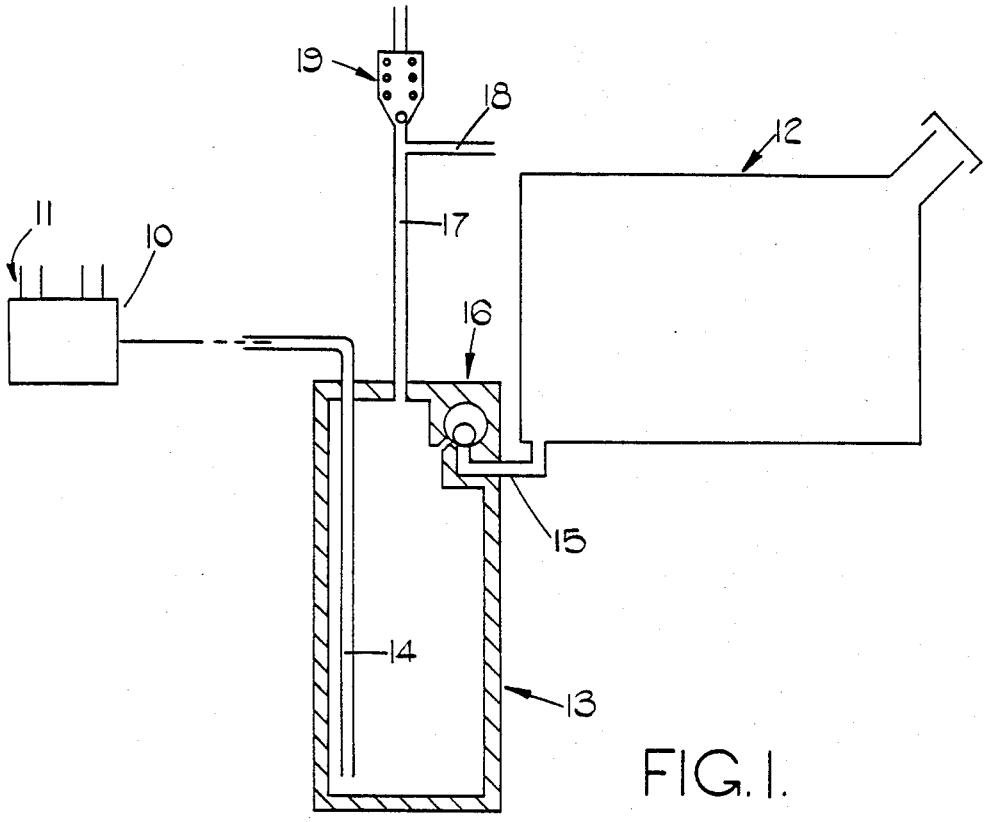

Referring to FIG. 1 of the drawings there is indicated at 10 a fuel delivery unit having a plurality of high pressure outlets 11 for connection in use to the injection nozzles of an associated engine. The pump 10 incorporates a low pressure fuel supply pump which supplies fuel to the high pressure pump and draws the fuel from a supply tank indicated at 12. There will in practice, be disposed intermediate the tank 12 and the low pressure pump, at least a fuel filter and possibly also some other form of fuel treatment device. The low pressure pump may in some instances, be separated from the high pressure pump but it will be mounted on the associated engine so as to be driven thereby.

The fuel supply system includes a subsidiary fuel tank 13 into which extends a pipe connected to the fuel inlet of the low pressure pump. The pipe which is indicated at 14, extends to adjacent the lower portion of the tank 13. Most of the tank 13 is disposed below the supply tank 12 and it is connected to the tank 12 by way of a conduit 15 which incorporates a non-return valve generally indicated at 16. The valve is disposed so as to permit fuel to flow under the action of gravity, from the tank 12 into the tank 13.

Communicating with the upper portion of the tank 13 is an air inlet pipe 17 which by means of a branch pipe 18, can be connected to a source of air under pressure. A safety valve 19 is provided to limit the pressure which can be attained in the tank 13. In use, when the system is empty of fuel or air has been allowed to enter the fuel system for example when the filter element is changed, the fuel in the tank 13 is pressurized by connecting the branch passage 18 to a source of air under pressure, for example, a foot operated pump or a reservoir for air, for example, a spare wheel. The fuel in the tank 13 being pressurized flows towards the fuel pump 11 which may incorporate a vent plug which can be removed to enable the air to be vented. When it is established that the air has been vented the associated engine can be started and the source of air under pressure disconnected from the passage 18. It will be noted that the passage 18 terminates at a position above the fuel tank 12 to prevent fuel flowing through the passage under the action of gravity.

Figure 2:
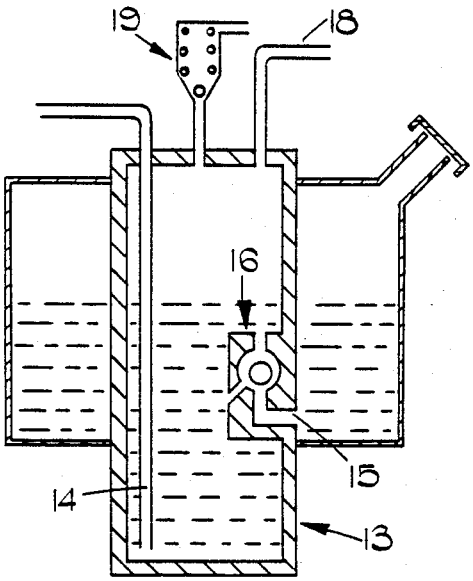

A modification of the system shown in FIG. 1 is shown in FIG. 2 and in this example, the subsidiary fuel tank 13 is combined with the supply tank 12, the conduit 15 in this example being a short passage between the peripheral surface of the tank 13 and the valve 16.

Figure 3:
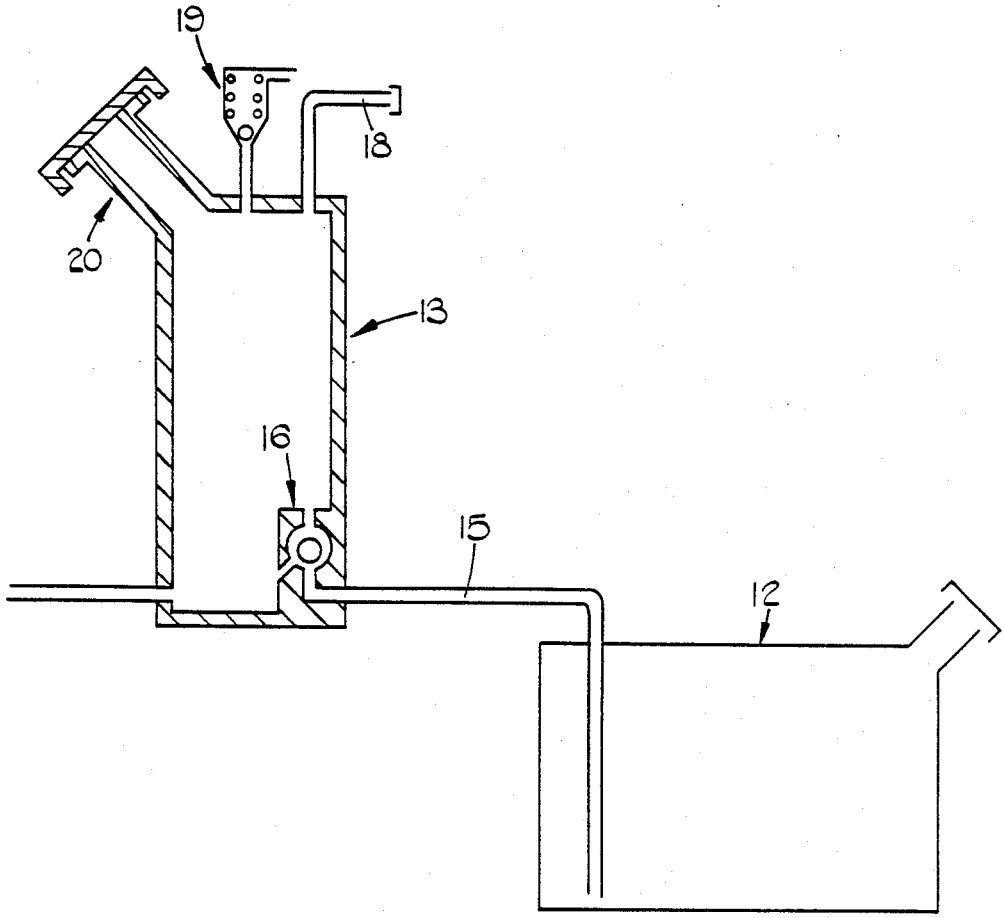

In the example which is shown in FIG. 3 the tank 13 is disposed above the supply tank 12 and since in this example, fuel cannot flow by gravity from the tank 12 to the tank 13, the latter is provided with a fuel inlet 20 which can be closed by a suitable cap in an air tight manner. Moreover, the passage 18 is also provided with a cap. In this example when the fuel tanks have been allowed to run dry both tanks are filled with fuel and the cap is replaced on the fuel inlet 20 and the fuel contained in the tank 13 pressurized as described. Once venting of the air has taken place, the associated engine may be started. It is preferable however to de-pressurize the tank 13 and close the passage 18 before this takes place. Whereas in the examples of FIGS. 1 and 2 the fuel flows by gravity from the supply tank 12 into the subsidiary tank, in the example shown in FIG. 3 the fuel is drawn from the tank 12 through the tank 13, by the action of the low pressure pump. Hence it is necessary to ensure that the passage 18 and also the inlet 20 are closed otherwise the engine will only run for as long as the tank 13 contains fuel.

I claim:

1. A fuel supply system for an internal combustion engine comprising a fuel delivery unit through which fuel can be supplied to an associated engine, a fuel supply pump for supplying fuel to the delivery unit, a supply tank from which fuel in use is drawn by the supply pump, a subsidiary fuel tank, a conduit through which said subsidiary fuel tank can be supplied with fuel from the supply tank, a one way valve in said conduit, said one way valve acting to prevent the flow of fuel from the subsidiary fuel tank to the supply tank and a further conduit through which said subsidiary fuel tank can be pressurized with air to force fuel from the subsidiary fuel tank towards said fuel delivery unit.

2. A system according to claim 1 including a safety valve for limiting the pressure which can be attained in the subsidiary fuel tank.

3. A system according to claim 1 or claim 2 in which said subsidiary fuel tank is positioned so that fuel can flow through said first mentioned conduit under the action of gravity.

4. A system according to claim 3 in which said subsidiary fuel tank is located partly within said supply tank.

5. A system according to claim 1 or claim 2 in which said subsidiary fuel tank is disposed above said supply tank, said subsidiary fuel tank having a fuel inlet whereby the tank can be filled with fuel, and a cap for sealing said inlet.

* * * * *